US005262619A

United States Patent [19]

Karner

[11] Patent Number: 5,262,619

[45] Date of Patent: Nov. 16, 1993

[54] HEATING DEVICE WITH PTC RESISTORS NON-ABRASIVELY POSITIONED IN A METALLIC HEAT BODY FOR HEATING FLOWING MEDIA

[75] Inventor: Robert Karner, Graz, Austria

[73] Assignee: Siemens Matsushita Components GmbH & Co. KG, Munich, Fed. Rep. of Germany

[21] Appl. No.: 927,464

[22] Filed: Aug. 10, 1992

[30] Foreign Application Priority Data

Aug. 12, 1991 [DE] Fed. Rep. of Germany ..... 4126633

[51] Int. Cl.[5] ..... H05B 1/02; H05B 3/14; H01C 7/02

[52] U.S. Cl. ..... 392/485; 219/505; 219/530; 219/541; 219/544; 338/22 R; 392/484

[58] Field of Search ..... 219/504, 505, 530, 540, 219/544, 541; 392/502, 485, 480, 484; 338/22 R; 123/547

[56] References Cited

U.S. PATENT DOCUMENTS

| | | | |
|---|---|---|---|
| 4,371,778 | 2/1983 | Meixner | 219/505 X |
| 4,395,623 | 7/1983 | Shimada et al. | 338/22 R |
| 4,626,666 | 12/1986 | Maeda et al. | 219/505 X |
| 4,700,050 | 10/1987 | Hennuy et al. | 219/505 X |
| 4,899,032 | 2/1990 | Schwarzl et al. | 219/505 X |
| 4,998,008 | 3/1991 | Menhardt | 219/505 X |
| 5,086,747 | 2/1992 | Curhan | 123/547 |
| 5,142,265 | 8/1992 | Motoyoshi et al. | 338/22 R |

FOREIGN PATENT DOCUMENTS

| | | | |
|---|---|---|---|
| 194507 | 2/1986 | European Pat. Off. | 392/485 |
| 4013212 | 12/1990 | Fed. Rep. of Germany . | |

*Primary Examiner*—Anthony Bartis
*Attorney, Agent, or Firm*—Herbert L. Lerner; Laurence A. Greenberg

[57] ABSTRACT

A heating device for heating flowing media includes a heat exchanger to be heated by PTC resistors. The heat exchanger is formed of thermally conductive metal having a slit-like pocket formed therein defining a given shape and defining pocket surfaces facing one another. A cuboid substrate body has a shape adapted to the given shape and an introduction side to be introduced into the pocket. The substrate body has opposed surfaces with recesses formed therein for receiving the PTC resistors and an internal conduit formed therein for receiving a contact spring. At least the surfaces of the substrate body having the recesses and the pocket surfaces facing the surfaces of the substrate body are beveled for decreasing the cross section of the substrate body and of the pocket from the introduction side inward, and for pressing the PTC resistors against the pocket surfaces upon introduction of the substrate body into the pocket with the PTC resistors located in the recesses.

2 Claims, 2 Drawing Sheets

HEATING DEVICE WITH PTC RESISTORS NON-ABRASIVELY POSITIONED IN A METALLIC HEAT BODY FOR HEATING FLOWING MEDIA

The present invention relates to a heating device for heating flowing media, including a heat exchanger being heated by PTC resistors and being formed of thermally conductive metal, the heat exchanger having a slit-like pocket formed therein, and a cuboid substrate body for PTC resistors having a shape adapted to the pocket, the substrate body having recesses on opposed surfaces for receiving the PTC resistors and an internal conduit for receiving a contact spring, so that upon introduction of the substrate body into the pocket with the PTC resistors located in its recesses, the PTC resistors are pressed against surfaces of the pocket that face one another.

A heating device of the above-described type is known from German Published, Non-Prosecuted Application DE 40 13 212 A1. In such a heating device, PTC resistors for heating a heat exchanger can be inserted directly, or by means of a substrate body, into a pocket in a metal body serving as a heat exchanger. A spring introduced between the PTC resistors presses a surface of each of them having a metal contact coating, against an associated surface of the metal body. In each case, the spring engages the other metal contact coating, so that the electrical connection of the PTC resistors is effected through the metal body forming the heat exchanger on one side, and the spring on the other.

In the heating device known from German Published, Non-Prosecuted Application DE 40 13 212 A1, the pocket for receiving the PTC resistors in the metal body acting as a heat exchanger, has a rectangular cross section. When the PTC resistors are inserted into the pocket, the metal contact coatings of the PTC resistors therefore rub against the associated surfaces of the pocket, so that there is a danger of abrasion of the metal contact coatings and thus of an inadequate electrical contact between the PTC resistors and the metal body.

It is accordingly an object of the invention to provide a heating device for heating flowing media, which overcomes the hereinafore-mentioned disadvantages of the heretofore-known devices of this general type and which improves a heating device of the known type in such a way that upon insertion of PTC resistors into the pocket of the heat exchanger, abrasion of the metal contact coatings of the PTC resistors is avoided.

With the foregoing and other objects in view there is provided, in accordance with the invention, a heating device for heating flowing media, including a heat exchanger to be heated by PTC resistors. The heat exchanger is formed of thermally conductive metal having a slit-like pocket formed therein defining a given shape and defining pocket surfaces facing one another. A cuboid substrate body has a shape adapted to the given shape and has an introduction side to be introduced into the pocket. The substrate body has opposed surfaces with recesses formed therein for receiving the PTC resistors and it has an internal conduit formed therein for receiving a contact spring. At least the surfaces of the substrate body with the recesses and the pocket surfaces facing the surfaces of the substrate body are beveled for decreasing the cross section of the substrate body and of the pocket from the introduction side inward, and for pressing the PTC resistors against the pocket surfaces upon introduction of the substrate body into the pocket with the PTC resistors located in the recesses.

Other features which are considered as characteristic for the invention are set forth in the appended claims.

Although the invention is illustrated and described herein as embodied in a heating device for heating flowing media, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
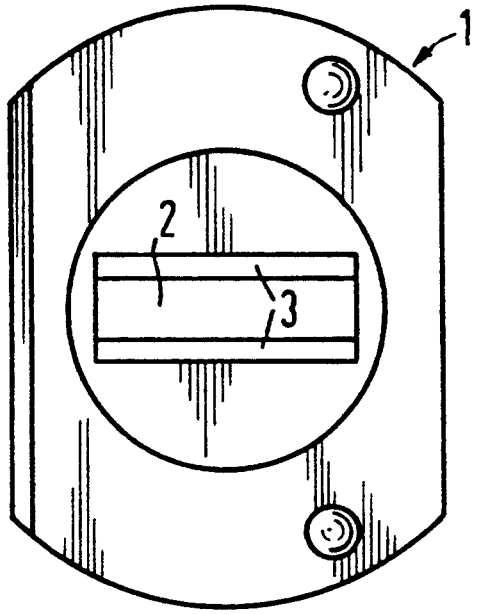
FIG. 1 is a diagrammatic, side-elevational view of a metal body serving as a heat exchanger, as seen from a side toward which a pocket for receiving PTC resistors opens.
Figure 2:
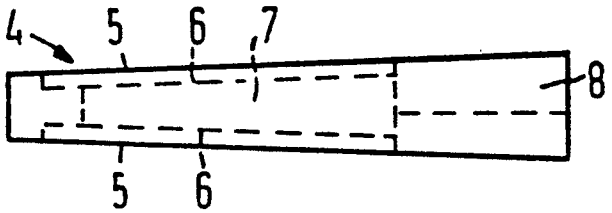
FIGS. 2 and 3 are respective side-elevational and perspective views of a substrate body for PTC resistors that can be inserted into the pocket of the metal body of FIG. 1.
Figure 3:
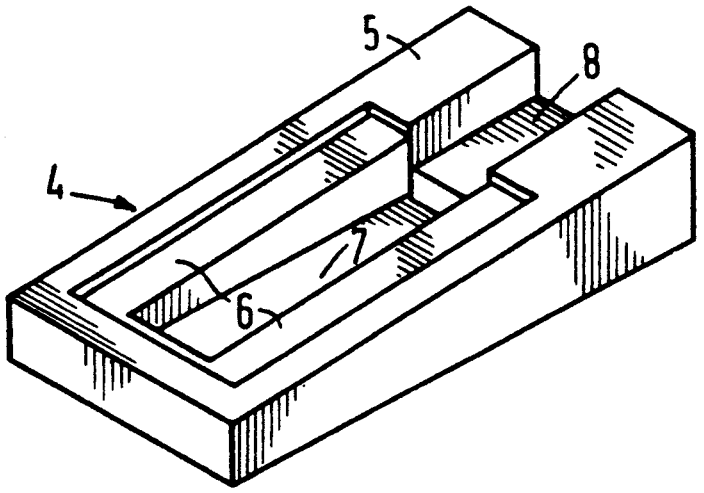

Referring now to the figures of the drawing in detail and first, particularly, to FIG. 1 thereof, there is seen a pocket 2 for receiving a substrate body 4 for PTC resistors, which is provided in a metal body 1 that is intended as a heat exchanger for a heating device for heating flowing media. The metal body 1 has opposed surfaces 3 at the pocket 2, which are beveled in a direction at right angles to the plane of the drawing, in such a way that the cross section of the pocket 2 decreases inwardly from the insertion side located in the plane of the drawing, at right angles to the plane of the drawing. The substrate body 4 for PTC resistors, as shown in FIGS. 2 and 3, may be made of plastic and has surfaces 5 with suitable beveling, oriented toward the surfaces 3 of the metal body 1. The substrate body 4 can be inserted into the metal body 1 at right angles to the plane of the drawing as seen in FIG. 1, by the end thereof having the smaller cross section.

The cuboid substrate body 4 is provided with recesses 6 on opposed sides of the surfaces 5, for receiving disk-shaped PTC resistors. An opening 7 is provided in the region or vicinity of these recesses 6, so that a contact spring can be thrust through a conduit 8 between the PTC resistors located in the recesses 6. After the introduction of the substrate body 4 into the pocket 2 of the metal body 1, the contact spring presses the PTC resistors against the surfaces 3 of the metal body 1 at the pocket 2 and effects the electrical contact thereof. However, it is also possible to integrate a spring and a contact pin into the substrate body 4, in order to press the PTC resistors into the pocket 2 and provide the electrical contact thereof. This possibility is not shown separately. It will be understood from the above-described embodiment of the metal body 1 and the substrate body 4, that metal contact coatings of the PTC resistors located in the recesses 6 cannot rub against the surfaces 3 as they are inserted into the pocket 2 of the metal body 1, because they practically do not come into contact with the surfaces 3 until after the substrate body 4 has been fully inserted into the pocket 2. Therefore, not only is there an avoidance of abrasion of metal contact coatings of the PTC resistors on the surfaces 3 of the metal body 1 at the pocket 2, but the PTC resistors are also pressed against these surfaces with relatively great pressure.

Figure 4:
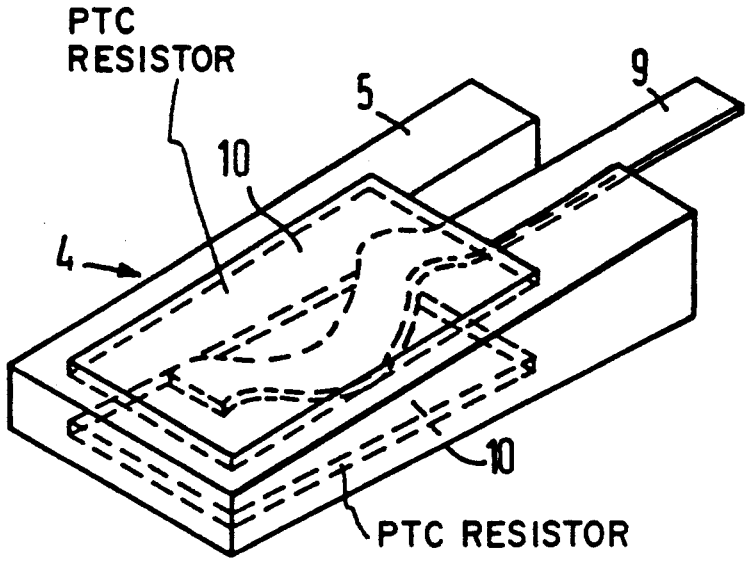
FIG. 4 is a perspective view of the substrate body with a PTC resistor and a spring mounted thereon.

FIG. 4 shows two disk-shaped PTC resistors 10 inserted in the recesses 6. A contact spring 9 inserts in the opening 7 formed between the PTC resistors 10 and presses the PTC resistors 10 outwardly, i.e. towards the surfaces 3 when the substrate body 4 is inserted in the body 1.

Figure 5:
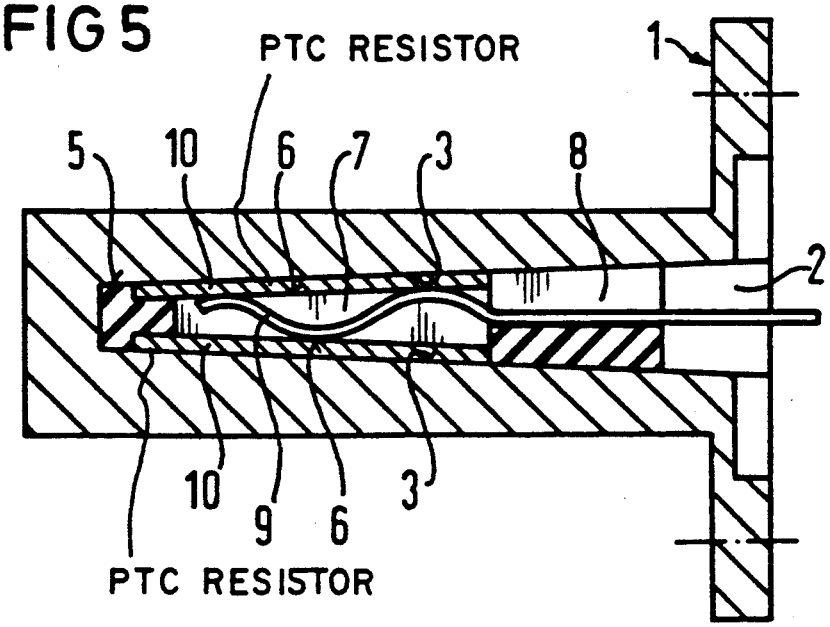
FIG. 5 is a longitudinal sectional view showing the substrate body and PTC resistors inserted into the pocket of the metallic heat exchanger body.

FIG. 5 shows the substrate body 4 fully inserted into the pocket 2 of the metal body 1. The metal spring 9 extends through the conduit 8 into the opening 7 defined between the PTC resistors 10, which are inserted in the recesses 6, and the spring 9 presses the PTC resistors 10 against the surfaces 3.

I claim:

1. A heating device for heating flowing media, comprising:

a heat exchanger to be heated by PTC resistors, said heat exchanger being formed of thermally conductive metal having a slit-like pocket open at one end formed therein defining a given shape and defining pocket surfaces facing one another, a cuboid substrate body formed of electrically insulative material and having a shape adapted to said given shape and having an introduction side to be introduced into said pocket through said open end, said substrate body having opposed surfaces with recesses formed therein and having an internal conduit formed therein, PTC resistors disposed in said recesses formed in said opposed surfaces of said substrate body and having inner contact surfaces and outer contact surfaces, and a contact spring disposed in said internal conduit formed in said substrate body and being in contact with said inner contact surfaces, at least said surfaces of said substrate body having said recesses and said pocket surfaces facing said surfaces of said substrate body being beveled for decreasing the cross section of said substrate body and of said pocket from said introduction side inward, and for pressing said outer contact surfaces of said PTC resistors against said pocket surfaces upon introduction of said substrate body into said pocket.

2. A heating device for heating flowing media, comprising:

a heat exchanger bring formed of thermally conductive metal having a slit-like pocket open at one end formed therein defining a given shape and defining pocket surfaces facing one another, a cuboid substrate body made of electrically insulative material and having a shape adapted to said given shape and having an introduction side to be introduced into said pocket through said open end, said substrate body having opposed surfaces with recesses formed therein and having an internal conduit formed therein, PTC resistors disposed in said recesses, said PTC resistors having inner contact surfaces, and a contact spring disposed in said internal conduit and being in contact with said inner contact surfaces, at least said surfaces of said substrate body having said recesses and said pocket surfaces facing said surfaces of said substrate body being beveled for decreasing the cross section of said substrate body and of said pocket from said introduction side inward.

* * * * *